US012195153B2

(12) United States Patent
Hamilton et al.

(10) Patent No.: US 12,195,153 B2
(45) Date of Patent: Jan. 14, 2025

(54) UNDERWATER VEHICLE DOCKING SYSTEM

(71) Applicants: NORTHROP GRUMMAN SYSTEMS CORPORATION, Falls Church, VA (US); MONTEREY BAY AQUARIUM RESEARCH INSTITUTE, Moss Landing, CA (US)

(72) Inventors: Andrew Hamilton, Santa Cruz, CA (US); Brett Hobson, Carmel, CA (US); François Cazenave, Santa Cruz, CA (US); Scott Jensen, San Martin, CA (US)

(73) Assignees: NORTHROP GRUMMAN SYSTEMS CORPORATION, Falls Church, VA (US); MONTEREY BAY AQUARIUM RESEARCH INSTITUTE, Moss Landing, CA (US)

( * ) Notice: Subject to any disclaimer, the term of this patent is extended or adjusted under 35 U.S.C. 154(b) by 69 days.

(21) Appl. No.: 18/315,919

(22) Filed: May 11, 2023

(65) Prior Publication Data

US 2023/0365241 A1 Nov. 16, 2023

Related U.S. Application Data

(60) Provisional application No. 63/342,291, filed on May 16, 2022.

(51) Int. Cl.
*B63G 8/00* (2006.01)

(52) U.S. Cl.
CPC ..... *B63G 8/001* (2013.01); *B63G 2008/008* (2013.01)

(58) Field of Classification Search
CPC ..... B63G 8/001; B63G 2008/008
See application file for complete search history.

(56) References Cited

U.S. PATENT DOCUMENTS 10,868,384 B1 * 12/2020 Windgassen ..... H01R 13/03
11,069,995 B1 * 7/2021 Hack ..... H01R 13/523
(Continued)

FOREIGN PATENT DOCUMENTS

CN 110520352 11/2019
CN 113772061 A 12/2021
CN 113928136 A * 1/2022 ..... B60L 53/12

OTHER PUBLICATIONS

TWOA: Office Action issued Jun. 6, 2024 for corresponding Taiwan Patent Application No. 112117961.
(Continued)

*Primary Examiner* — Anthony D Wiest
(74) *Attorney, Agent, or Firm* — Tarolli, Sundheim, Covell & Tummino LLP

(57) ABSTRACT

One example includes an underwater docking system. The system includes an underwater dock that includes a docking rod. The docking rod includes electrical contacts around a periphery of the docking rod. The system also includes a docking assembly mounted on an underwater vehicle. The docking assembly includes an actuator and a hook assembly that includes a docking arm and a jaw assembly. The docking arm physically guides the docking rod into the jaw assembly and the actuator closes the jaw assembly around the docking rod to provide electrical connection of brush contacts of the jaw assembly with the electrical contacts of the docking rod to provide electrical power from a power source via the electrical contacts to the underwater vehicle. Each of the electrical contacts and the brush contacts can be formed from a self-passivating material.

20 Claims, 9 Drawing Sheets

(56) References Cited

U.S. PATENT DOCUMENTS

| | | | |
|---|---|---|---|
| 2018/0154994 | A1 | 6/2018 | Stone et al. |
| 2018/0297677 | A1 | 10/2018 | Sakaue et al. |
| 2018/0319473 | A1 | 11/2018 | Sakaue et al. |
| 2021/0072746 | A1 | 3/2021 | Mukaida et al. |

OTHER PUBLICATIONS

WOISR (Written Opinion & International Search Report) for corresponding PCT/US2023/022063, mailed May 3, 2024.

* cited by examiner

UNDERWATER VEHICLE DOCKING SYSTEM

RELATED APPLICATIONS

This application claims priority from U.S. Provisional Application Ser. No. 63/342,291, filed 16 May 2022, which is incorporated herein in its entirety.

TECHNICAL FIELD

The present invention relates generally to underwater vehicle systems, and specifically to an underwater vehicle docking system.

BACKGROUND

Docking technology for underwater vehicles, such as autonomous underwater vehicles (AUVs), has been a challenge in the underwater vehicle research community. A typical system for docking AUVs includes a structure to bring torpedo-shaped cruising vehicles to rest quickly, which is necessary because these vehicles lose controllability at low speed. In one example for docking torpedo-shaped cruising vehicles, compliant cone shapes are usually used to bring the vehicle to rest within one vehicle length or so, which may be a violent deceleration for the vehicle and the internal components of the vehicle. Once the AUV is docked, powering and re-charging the AUV is typically performed by rigidly aligning the vehicle to the docking structure for power transfer through traditional underwater connectors or inductive charging. The combination of these requirements has typically resulted in large seafloor installations that often require Remotely Operated Vehicle (ROV) access for installation.

SUMMARY

One example includes an underwater docking system. The system includes an underwater dock that includes a docking rod. The docking rod includes electrical contacts around a periphery of the docking rod. The system also includes a docking assembly mounted on an underwater vehicle. The docking assembly includes an actuator and a hook assembly that includes a docking arm and a jaw assembly. The docking arm physically guides the docking rod into the jaw assembly and the actuator closes the jaw assembly around the docking rod to provide electrical connection of brush contacts of the jaw assembly with the electrical contacts of the docking rod to provide electrical power from a power source via the electrical contacts to the underwater vehicle. Each of the electrical contacts and the brush contacts can be formed from a self-passivating material.

Another example includes an underwater dock to provide for docking of an underwater vehicle. The system includes an anchor configured to secure the underwater dock to a seabed and a power source coupled to the anchor. The power source can be configured to provide electrical power. The dock also includes a docking rod electrically connected to the power source and comprising electrical contacts formed from a self-passivating material and disposed about a periphery of the docking rod. The electrical contacts can provide the electrical power to an underwater vehicle that is configured to dock with the underwater dock system via the docking rod.

Another example includes an underwater vehicle docking assembly associated with an underwater vehicle. The assembly includes a hook assembly comprising a docking arm and a jaw assembly. The docking arm can be configured to guide the docking rod into the jaw assembly. The jaw assembly can include a set of brush contacts formed from a self-passivating material. The assembly also includes an actuator configured to close the jaw assembly around the docking rod in response to the docking rod being positioned in the jaw assembly to provide electrical connection of the brush contacts of the jaw assembly with electrical contacts of the docking rod to provide electrical power from the underwater dock via the electrical contacts to the underwater vehicle.

Another example includes a method for docking an underwater vehicle to an underwater dock. The method includes extending a docking arm from a hook assembly mounted to the underwater vehicle in response to detecting a location of the underwater vehicle to within a threshold distance of the underwater dock and guiding a docking rod associated with the underwater dock into a jaw assembly associated with the hook assembly. The method also includes detecting entry of the docking rod into the jaw assembly via a proximity sensor and closing the jaw assembly around the docking rod via an actuator in response to detecting the entry of the docking rod into the jaw assembly to provide electrical connection of a set of brush contacts of the jaw assembly with electrical contacts of the docking rod. Each of the electrical contacts and the brush contacts can be formed from a self-passivating material. The method further includes providing electrical power from the underwater dock via the electrical contacts and the brush contacts to the underwater vehicle.

DETAILED DESCRIPTION

Figure 1:
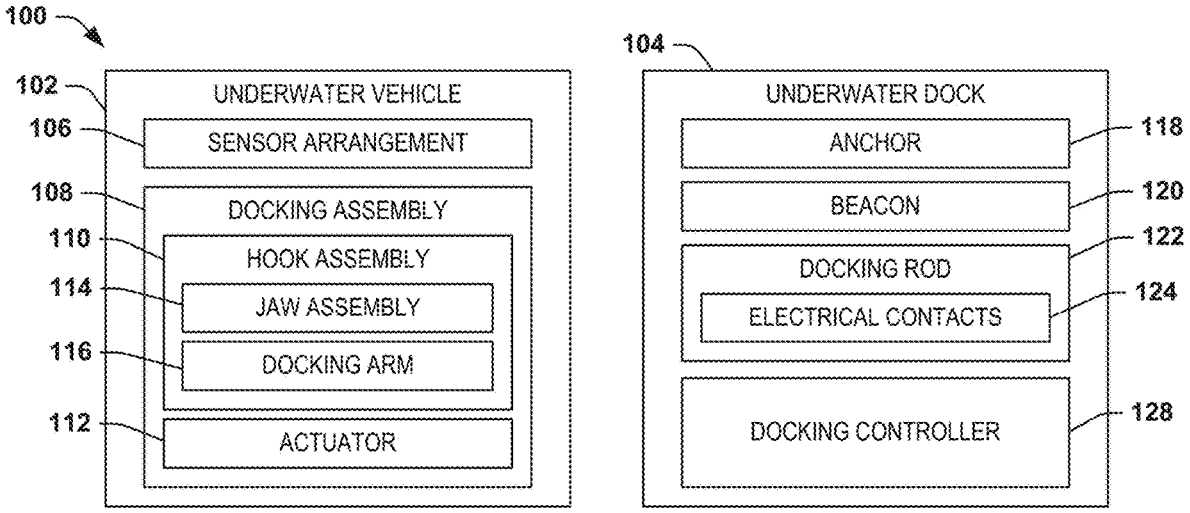
FIG. 1 illustrates an example block diagram of an underwater docking system.

The present invention relates generally to underwater vehicle systems, and specifically to an underwater vehicle docking system. An underwater vehicle, such as an autonomous underwater vehicle (AUV), can include a docking assembly to provide charging power and/or data communications to the underwater vehicle. The docking assembly can include an electrical connector including a plurality of self-insulating brush contacts, an actuator configured to open and close the electrical connector, a proximity sensor configured to detect the presence of a docking rod within the electrical connector, and a processor configured to cause the actuator to close the electrical connector in response to the proximity sensor detecting the docking rod within the electrical connector. The underwater vehicle can further include a battery configured to provide power to the underwater vehicle and a bridge circuit configured to rectify electrical power provided from the docking rod to charge the battery.

The underwater vehicle docking system can also include an underwater dock that can be anchored to a fixed location underwater. The underwater dock includes a docking rod that includes at least two self-insulating electrical contacts and a structural member configured to separate the pair of self-insulating electrical contacts. The underwater dock can also include a docking controller that can include or can provide switching to a power source configured to provide electrical power (e.g., charging power and/or data) to the underwater vehicle through the docking rod. The underwater dock can also include a beacon configured to enable the underwater vehicle to locate the underwater dock.

As an example, the brush contacts on the docking assembly of the underwater vehicle and the self-insulating electrical contacts on the docking rod of the underwater dock can be formed from an electrically conductive self-passivating material. The electrically conductive self-passivating material can be selected from a group containing niobium, tantalum, titanium, zirconium, molybdenum, ruthenium, rhodium, palladium, hafnium, tungsten, rhenium, osmium, and iridium. As described herein, the terms "self-insulating" and "self-passivating" are used interchangeably. Therefore, based on the self-passivating material that forms the brush contacts and the electrical contacts, the brush contacts and the electrical contacts can be exposed to the underwater environment without electrical arcing. Accordingly, the underwater docking system can be implemented to provide for docking of the underwater vehicle to the underwater dock in a manner that can require significantly less precise alignment, and thus without rigidly constraining the underwater vehicle. As a result, the underwater vehicle can achieve docking with a less violent deceleration of the underwater vehicle, the ability for the underwater vehicle to approach and dock from any direction, and a smaller seafloor installation that does not require Remotely Operated Vehicle (ROV) manipulations for installation and service.

FIG. 1 illustrates an example block diagram of an underwater docking system 100. The underwater docking system 100 includes an underwater vehicle 102 and an underwater dock 104 that can facilitate docking of the underwater vehicle 102 to the underwater dock 104, such as to provide charging of the battery system of the underwater vehicle 102 and/or to provide data communication to the underwater vehicle 102. As an example, the underwater vehicle 102 can be arranged as an autonomous underwater vehicle (AUV). The underwater vehicle 102 can be implemented for a variety of purposes, such as undersea research.

In the example of FIG. 1, the underwater vehicle 102 includes a sensor arrangement 106 and a docking assembly 108. The sensor arrangement 106 can include a variety of sensors to provide for navigation and mission functionality to the underwater vehicle 102. As described in greater detail herein, the sensor arrangement 106 can also be implemented to find the underwater dock 104 to provide charging power and/or data communications to the underwater vehicle 102. The docking assembly 108 includes a hook assembly 110 and an actuator 112. As an example, the docking assembly 108 can be mounted on an exterior lateral side of the underwater vehicle 102, such as less than approximately one-half along the length of the underwater vehicle 102 from the front of the underwater vehicle 102. Therefore, as described in greater detail herein, the position of the docking assembly 108 can provide for deceleration of the underwater vehicle 102 upon docking with the underwater dock 104, such as based on facilitating a yaw motion of the underwater vehicle 102 upon contact of the underwater vehicle 102 with the underwater dock 104.

In the example of FIG. 1, the hook assembly 110 includes a jaw assembly 114 and a docking arm 116. As an example, the jaw assembly 114 can include a plurality of self-insulating brush contacts that can provide electrical connection to the underwater dock 104 to provide the charging power to the underwater vehicle 102, as described in greater detail herein. As described herein, the brush contacts of the jaw assembly 114 can be formed from an electrically conducting self-passivating material selected from a group containing niobium, tantalum, titanium, zirconium, molybdenum, ruthenium, rhodium, palladium, hafnium, tungsten, rhenium, osmium, and iridium. Therefore, based on the self-passivating material that forms the brush contacts of the jaw assembly 114, the brush contacts can be exposed to the underwater environment without electrical arcing.

In the example of FIG. 1, the underwater dock 104 includes an anchor 118 and a beacon 120. The anchor 118 is configured to mount the underwater dock 104 to the sea floor to provide a stationary mount for the underwater dock 104. The beacon 120 is configured to provide a location signal that can be received by the underwater vehicle 102 to locate the underwater dock 104 to facilitate docking of the underwater vehicle 102 to the underwater dock 104. As an example, the beacon 120 can be configured to provide a sonar ping signal, such as periodically or in response to a sonar ping signal provided from the underwater vehicle 102 (e.g., via the sensor arrangement 106). Alternatively, the beacon 120 could provide an optical signal, such that the sensor arrangement 106 could implement optical homing techniques. Therefore, the underwater vehicle 102 can determine a physical location of the underwater dock 104 based on the location signal provided by the beacon 120.

The underwater dock 104 also includes a docking rod 122 that can be arranged as a flexible or semi-flexible rod that includes a set of electrical contacts 124 with which the docking assembly 108 of the underwater vehicle 102 engages to provide the charging power and/or data communications from the underwater dock 104 to the underwater vehicle 102. For example, the electrical contacts 124 can be arranged as a pair of electrical contacts 124 disposed along respective opposite portions of the periphery of the docking rod 122, such that the pair of electrical contacts 124 can also include a pair of insulating portions between the pair of electrical contacts 124 of the periphery of the docking rod 122. As described in greater detail herein, the jaw assembly 114 can be closed around the docking rod to provide electrical connection of the brush contacts of the jaw assembly 114 with each of the pair of electrical contacts 124 of the docking rod 122 when the jaw assembly 114 is closed around the docking rod 122. Similar to as described above, the electrical contacts 124 can be formed from an electrically conducting self-passivating material selected from a group containing niobium, tantalum, titanium, zirconium, molybdenum, ruthenium, rhodium, palladium, hafnium, tungsten, rhenium, osmium, and iridium. Therefore, based on the self-passivating material that forms the electrical contacts 124, the electrical contacts 124 can be exposed to the underwater environment without electrical arcing.

The underwater dock 104 further includes a docking controller 128. The docking controller 128 includes the electronics that can facilitate the docking process of the underwater vehicle 102 to the underwater dock 104. For example, the docking controller 128 can be powered by a seafloor cable to a nearby power source, such as the anchor of a surface buoy or sub-surface power node. However, the docking controller 128 may also be powered by another method, such as through solar power provided from a surface float or buoy, or through tidal/wave action. The docking controller 128 can include a power source that provides the charging power or can facilitate switching to the power source to provide the charging power.

To provide docking of the underwater vehicle 102 to the underwater dock 104, the docking arm 116 can be configured to guide the docking rod 122 to the jaw assembly 114 in response to forward momentum of the underwater vehicle 102. For example, the docking arm 116 can be switched from a closed state to an open state, such as in response to the underwater vehicle 102 approaching to within a threshold distance of the underwater dock 104 (e.g., as provided by the beacon 120). Thus, the docking arm 116 can operate as a hook to catch the docking rod 122 as the underwater vehicle 102 passes the underwater dock 104. In response to the docking rod 122 being positioned in the jaw assembly 114, the actuator 112 can be configured to close the jaw assembly 114 (e.g., by switching the docking arm 116 to a closed state), such that the jaw assembly 114 can be closed around the docking rod 122. Therefore, the brush contacts of the jaw assembly 114 can provide electrical connection with the electrical contacts 124 of the docking rod 122. For example, the brush contacts of the jaw assembly 114 can be spring-loaded to provide sufficient contact pressure to scrape away the passivation of the self-passivating materials of the brush contacts and the electrical contacts 124, thereby providing electrical connection. Accordingly, the docking controller 128 can provide the charging power (e.g., via a power source) and/or data communications to the underwater vehicle 102 via the electrical connection between the electrical contacts 124 of the docking rod 122 and the brush contacts of the jaw assembly 114.

Figure 2:
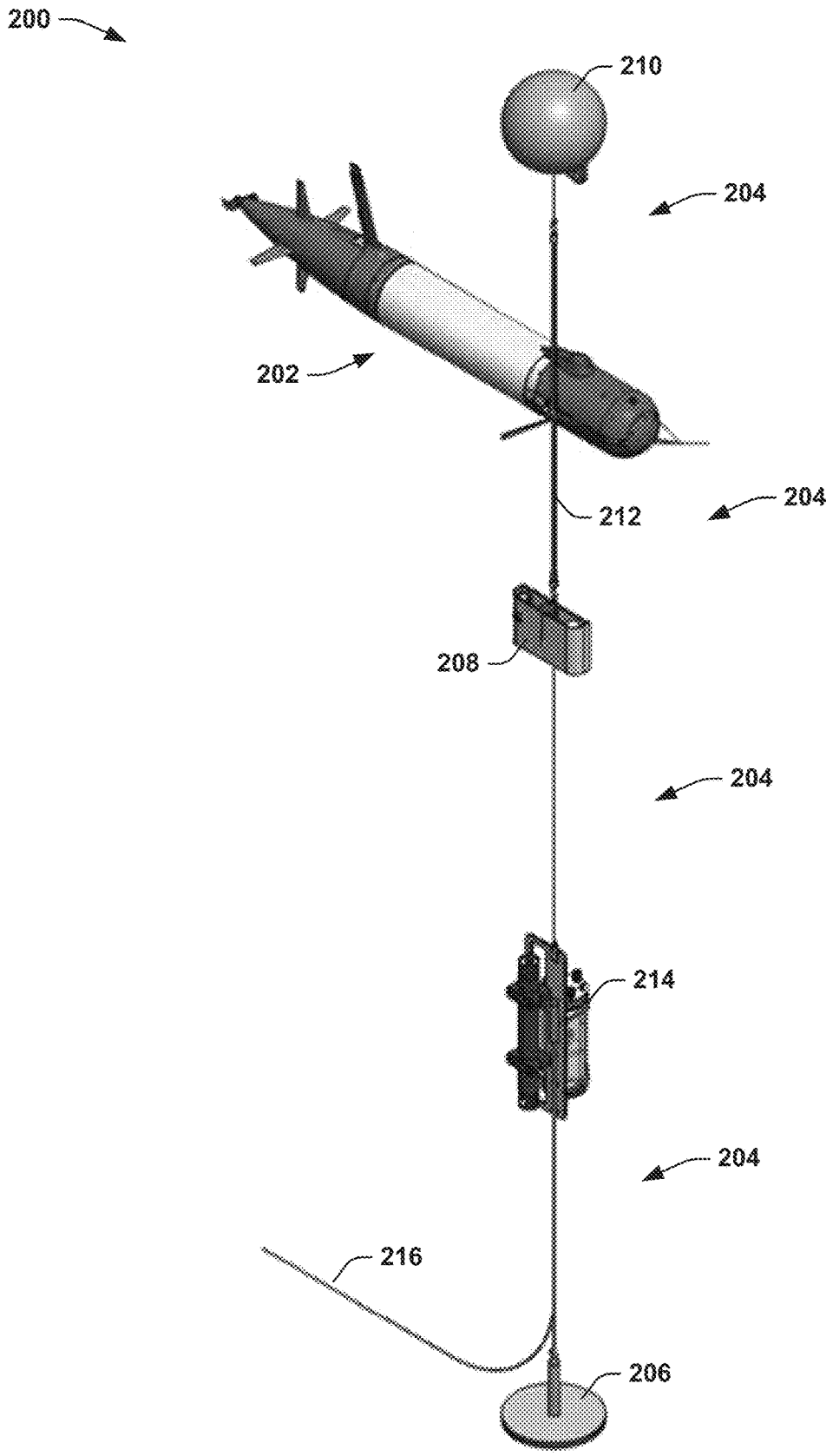
FIG. 2 illustrates an example of an underwater docking system.

FIG. 2 illustrates an example of an underwater docking system 200. The underwater docking system 200 is demonstrated in a perspective (isometric) view. The underwater docking system 200 includes an underwater vehicle 202 configured as a torpedo-shaped AUV. While the example of the underwater vehicle 202 is a torpedo-shaped AUV in the example of FIG. 2, the underwater vehicle 202 could instead be configured as any other type or shape of underwater vehicle, and is not limited to being autonomous. The underwater docking system 200 also includes an underwater dock 204 that can facilitate docking of the underwater vehicle 202 to the underwater dock 204, such as to provide charging of the battery system of the underwater vehicle 202 and/or to provide data communication to the underwater vehicle 202. As an example, the underwater vehicle 202 may include a processor and a memory configured to implement a docking algorithm to enable the underwater vehicle 202 to implement the docking process with the underwater dock 204. The example of FIG. 2 demonstrates the relatively small size and weights of the components of the underwater docking system 200, which allows deployment from the surface without ROV interventions.

In the example of FIG. 2, the underwater dock 204 includes an anchor 206 and a beacon 208. The anchor 206 is configured to mount the underwater dock 204 to the sea floor to provide a stationary mount for the underwater dock 204. The beacon 208 is configured to provide a location signal that can be received by the underwater vehicle 202 to locate the underwater dock 204 to facilitate docking of the underwater vehicle 202 to the underwater dock 204. As an example, the beacon 208 can be configured to provide a sonar ping signal, such as periodically or in response to a sonar ping signal provided from the underwater vehicle 202 (e.g., via the sensor arrangement 106). Therefore, the underwater vehicle 202 can determine a physical location of the underwater dock 204 based on the location signal provided by the beacon 208.

The underwater dock 204 also includes a float 210 and a docking rod 212 that can be arranged as a flexible or semi-flexible rod. The float 210 is coupled to the docking rod 212 and is configured to provide an upward force on the docking rod 212, thereby providing for a vertical mooring of the underwater dock 204, and thus a vertical orientation of the docking rod 212 to facilitate docking of the underwater vehicle 202 (e.g., via the docking assembly 108) with the docking rod 212. While the example of FIG. 2 demonstrates that the float 210 provides the vertical mooring/orientation of the underwater dock 204, other arrangements are possible. For example, the underwater dock 204 could instead be suspended from a surface buoy or other above surface structure.

Similar to as described above in the example of FIG. 1, the docking rod 212 includes a set of electrical contacts with which the underwater vehicle 202 engages to provide the charging power and/or data communications from the underwater dock 204 to the underwater vehicle 202. As an example, the docking rod 212 can be arranged to have a sufficient length to allow for a margin of error of the docking of the underwater vehicle 202 based on a known range of depths of the docking rod 212. For example, the underwater vehicle 202 can be configured to maneuver to a specific depth upon approaching the underwater dock 204, such as relative to the sea floor, to provide docking to the docking rod 212 at a position along the length of the docking rod 212. Therefore, the docking rod 212 can have a sufficient length to allow for a margin of error of the depth of the underwater vehicle 202 during docking (e.g., approximately two meters).

The underwater dock 204 further includes a docking controller 214. The docking controller 214 includes the electronics that can control the underwater dock 204 and the docking process implemented thereby. For example, the docking controller 214 can be powered by a seafloor cable to a nearby power source, such as the anchor of a surface buoy or sub-surface power node. In the example of FIG. 2, an undersea cable 216 provides power (e.g., and data) to the docking controller 214. However, the docking controller 214 could instead be powered by any of a variety of other sources, such as a solar buoy, a wave buoy, a sub-sea turbine, etc.

As an example, the docking controller 214 can include a memory that is configured to store data, information, software, and/or instructions associated with the docking logic. The memory may store data/information in any suitable volatile and/or non-volatile computer readable storage media (e.g., magnetic hard disk drive, solid state hard drive, semiconductor storage device, random access memory (RAM), read only memory (ROM), erasable programmable read only memory (EPROM), application specific integrated circuit (ASIC), etc.), software, logic (fixed logic, hardware logic, programmable logic, analog logic, digital logic), hardware, and/or in any other suitable component, device, element, and/or object as may be appropriate. Any of the memory items discussed herein should be construed as being encompassed within the broad term "memory." The memory may include non-transitory memory elements, which may store instructions that are executed to perform one or more of the techniques described herein.

In the example of FIG. 2, the underwater vehicle 202 is demonstrated as docked with the docking rod 212. As described above in the example of FIG. 1, the underwater vehicle 202 includes a docking assembly that is mounted on an exterior lateral side of the underwater vehicle 202, such as less than approximately one-half along the length of the underwater vehicle 202 from the front of the underwater vehicle 202. Therefore, in response to docking with the docking rod 212, the position of the docking assembly can provide for deceleration of the forward momentum of the underwater vehicle 202 upon docking with the underwater dock 204 based on facilitating a yaw motion of the underwater vehicle 202 upon contact of the underwater vehicle 202 with the underwater dock 204. The result is that the relatively large amount of kinetic energy of the underwater vehicle 202 is dissipated by deflection in the docking rod 212, and by the resulting yaw motion of the underwater vehicle 202 as it swings around the docking rod 212.

Therefore, based on the compliance of the vertical mooring assembly of the underwater dock 204 and/or the flexible or semi-flexible construction of the docking rod 212, the deceleration of the underwater vehicle 202 can be provided in a manner that mitigates damage to the docking rod 212 and/or the docking assembly of the underwater vehicle 202. As an example, the docking rod 212 can axially slide through the jaw assembly of the docking assembly (e.g., based on rollers built into the jaw assembly) during the deceleration of the underwater vehicle 202. The underwater vehicle 202 can thus remain stationary while docked to the docking rod 212 to receive the charging power and/or the data communications provided from the docking controller 214 via the docking rod 212. After docking, the underwater vehicle 202 is not rigidly constrained and is free to float up and down according to the buoyancy of the underwater vehicle 202, and can swing around the docking rod 212 freely in response to currents.

Figure 3:
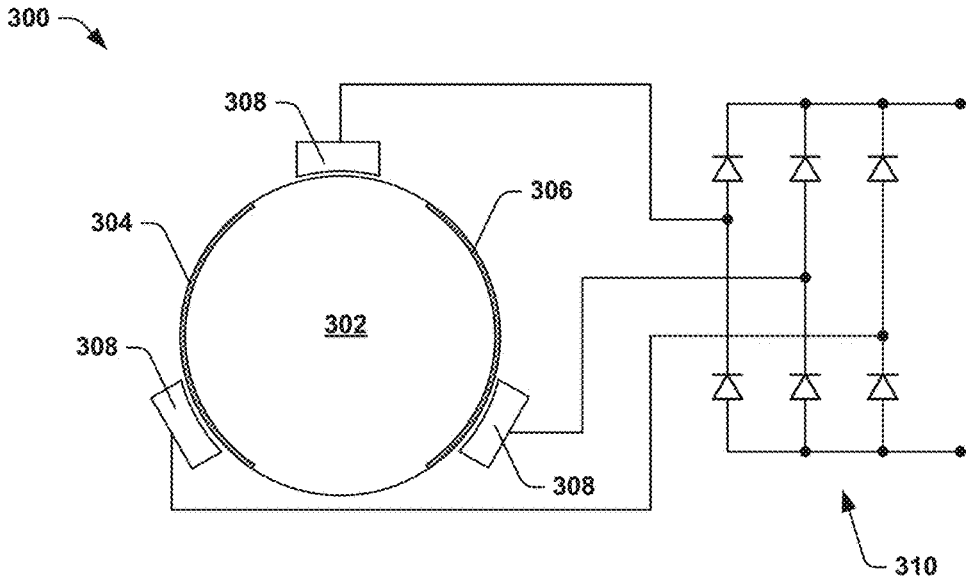
FIG. 3 illustrates an example diagram of electrical charging.

FIG. 3 illustrates another example diagram 300 of electrical charging. The diagram 300 demonstrates a diagrammatic view of a docking rod 302 that includes a first electrical contact 304 (e.g., carrying a positive DC voltage or an AC voltage) and a second electrical contact 306 (e.g., carrying a common, ground, or negative DC voltage). The diagram 300 also demonstrates three self-insulating brush contacts 308 associated with the jaw assembly electrically connected to the electrical contacts 304 and 306. The charging power can be provided from the electrical contacts 304 and 306 to a bridge circuit 310 that rectifies power drawn from the docking rod 302. Therefore, the connection of the brush contacts 308 to the electrical contacts 304 and 306 of the docking rod 302 is irrelevant with respect to specific orientation, and thus provides a consistent positive and negative voltage suitable for charging a battery on the underwater vehicle. As an example, additional electrical and/electronic components (e.g., capacitors, inductors, power supply circuitry, etc.) may be added to condition the power received from the docking rod 302.

As demonstrated in FIG. 3, using three brush contacts 308 results in electrical current being present in at least two of the three brush contacts as the underwater vehicle rotates about the docking rod 302. The changing polarity of the current may be rectified for battery charging by the diode bridge circuit 310. The "make-before-break" nature of the arrangement of the brush contacts 308, and the diode bridge arrangement of the bridge circuit 310 enable an uninterrupted path of the charging current to the underwater vehicle. The self-insulating property of the brush contacts 308 and the electrical contacts 304 and 306 enables the docking operation underwater.

In addition to providing charging power via the electrical contacts 304 and 306 and the brush contacts 308, the docking controller (e.g., the docking controller 128) can be configured to provide data communication to the underwater vehicle via the electrical contacts 304 and 306 and the brush contacts 308. As an example, the docking controller can be configured to amplitude modulate the data onto the charging power. For example, the charging power can have a nominal voltage (e.g., approximately 48 volts), such that the docking controller can be configured to increase or decrease the voltage by small amplitude changes (e.g., one or two volts) that can be encoded with data. However, other modulation techniques (e.g., frequency modulation) can instead be implemented. Accordingly, the underwater docking can provide battery charging and data transfer capability.

Figure 4:
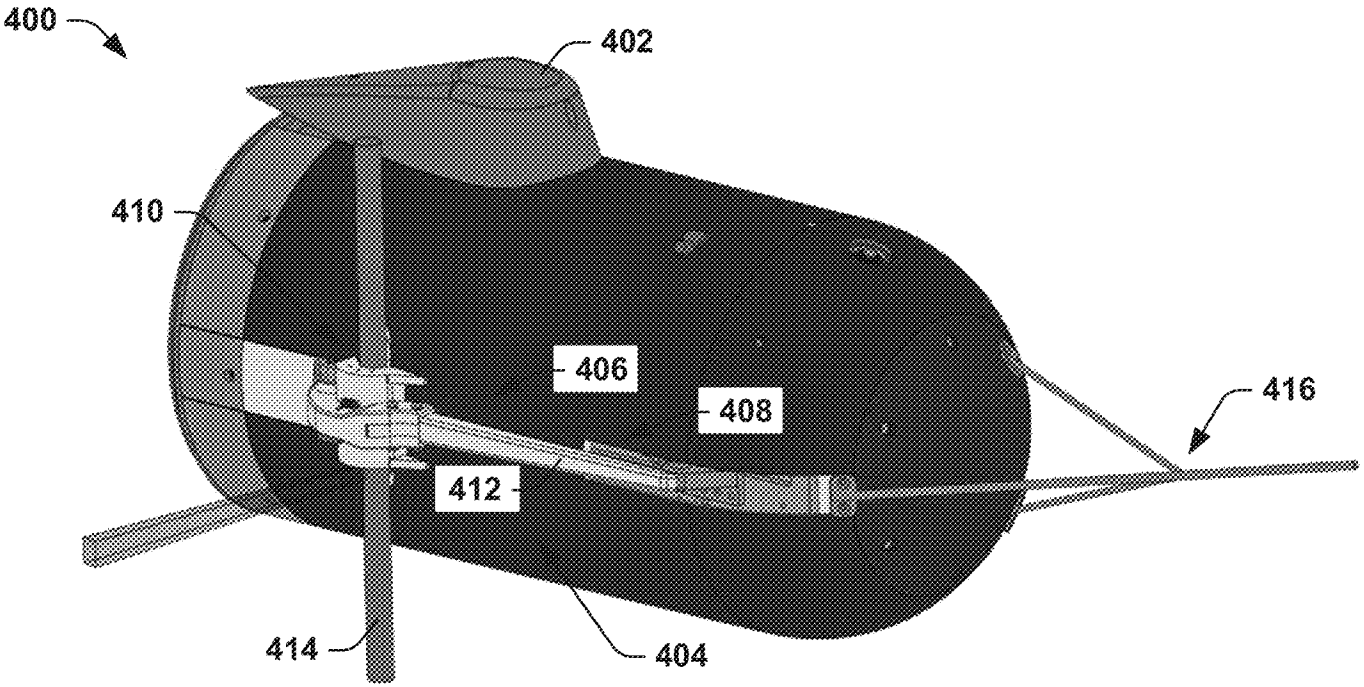
FIG. 4 illustrates an example of an underwater vehicle.

FIG. 4 illustrates an example of an underwater vehicle 400. The underwater vehicle 400 can correspond to the underwater vehicle 102 or the underwater vehicle 202 in the respective examples of FIGS. 1 and 2. Therefore, reference is to be made to the examples of FIGS. 1 and 2 in the following description of the example of FIG. 4.

The underwater vehicle 400 is demonstrated as a partial (e.g., front) view. The underwater vehicle 400 includes a sensor arrangement 402. The sensor arrangement 402 can include a variety of sensors to provide for navigation and mission functionality to the underwater vehicle 400. As described above, the sensor arrangement 402 can also be implemented to find the underwater dock to provide charging power and/or data communications to the underwater vehicle 400, such as in response to the location signal provided from the beacon 208 (e.g., sonar).

The underwater vehicle 400 also includes a docking assembly 404. The docking assembly 404 includes a hook assembly 406 and an actuator 408. In the example of FIG. 4, the docking assembly 404 is demonstrated as mounted on an exterior lateral side of the underwater vehicle 400, such as less than approximately one-half along the length of the underwater vehicle 400 from the front of the underwater vehicle 400. Therefore, as described above, the position of the docking assembly 404 can provide for deceleration of the underwater vehicle 400 upon docking with the underwater dock, such as based on facilitating a yaw motion of the underwater vehicle 400 upon contact of the underwater vehicle 400 with the underwater dock.

The hook assembly 406 includes a jaw assembly 410 and a docking arm 412. In the example of FIG. 4, the jaw assembly 410 is demonstrated as closed around a docking rod, demonstrated as 414, such as corresponding to the docking rod 212 of the underwater dock 204. As described herein, the jaw assembly 410 includes a plurality of self-insulating brush contacts that can provide electrical connection to the docking rod 414 to provide the charging power to the underwater vehicle 400. As described above, the brush contacts of the jaw assembly 410 and the electrical contacts of the docking rod 414 can each be formed from an electrically conducting self-passivating material to provide electrical contact underwater without arcing.

To provide the docking of the underwater vehicle 400 to the docking rod 414, the docking arm 412 can be configured to guide the docking rod 414 to the jaw assembly 410 in response to forward momentum of the underwater vehicle 400. For example, the docking arm 412 can be switched from a closed state to an open state, such as in response to the underwater vehicle 400 approaching to within a threshold distance of the underwater dock (e.g., as provided by the beacon 208). In the example of FIG. 4, the underwater vehicle 400 includes a guide structure 416 at the front of the underwater vehicle 400 to guide the docking rod 414 from the front of the underwater vehicle 400 to the lateral side of the underwater vehicle 400 that includes the docking assembly 404. The docking arm 412 can thus operate as a hook to catch the docking rod 414 as the underwater vehicle 400 passes the docking rod 414 on the lateral side.

In response to the docking rod 414 being positioned in the jaw assembly 410, the actuator 112 can be configured to close the jaw assembly 410 (e.g., by switching the docking arm 412 to a closed state), such that the jaw assembly 410 can be closed around the docking rod 414. Therefore, the brush contacts of the jaw assembly 410 can provide electrical connection with the electrical contacts 124 of the docking rod 414. For example, the brush contacts of the jaw assembly 410 can be spring-loaded to provide sufficient contact pressure to scrape away the passivation of the self-passivating materials of the brush contacts and the electrical contacts of the docking rod 414, thereby providing electrical connection. Accordingly, the docking controller of the underwater dock can provide the charging power and/or data communications to the underwater vehicle 400 via the electrical connection between the electrical contacts of the docking rod 414 and the brush contacts of the jaw assembly 410.

Figure 5:
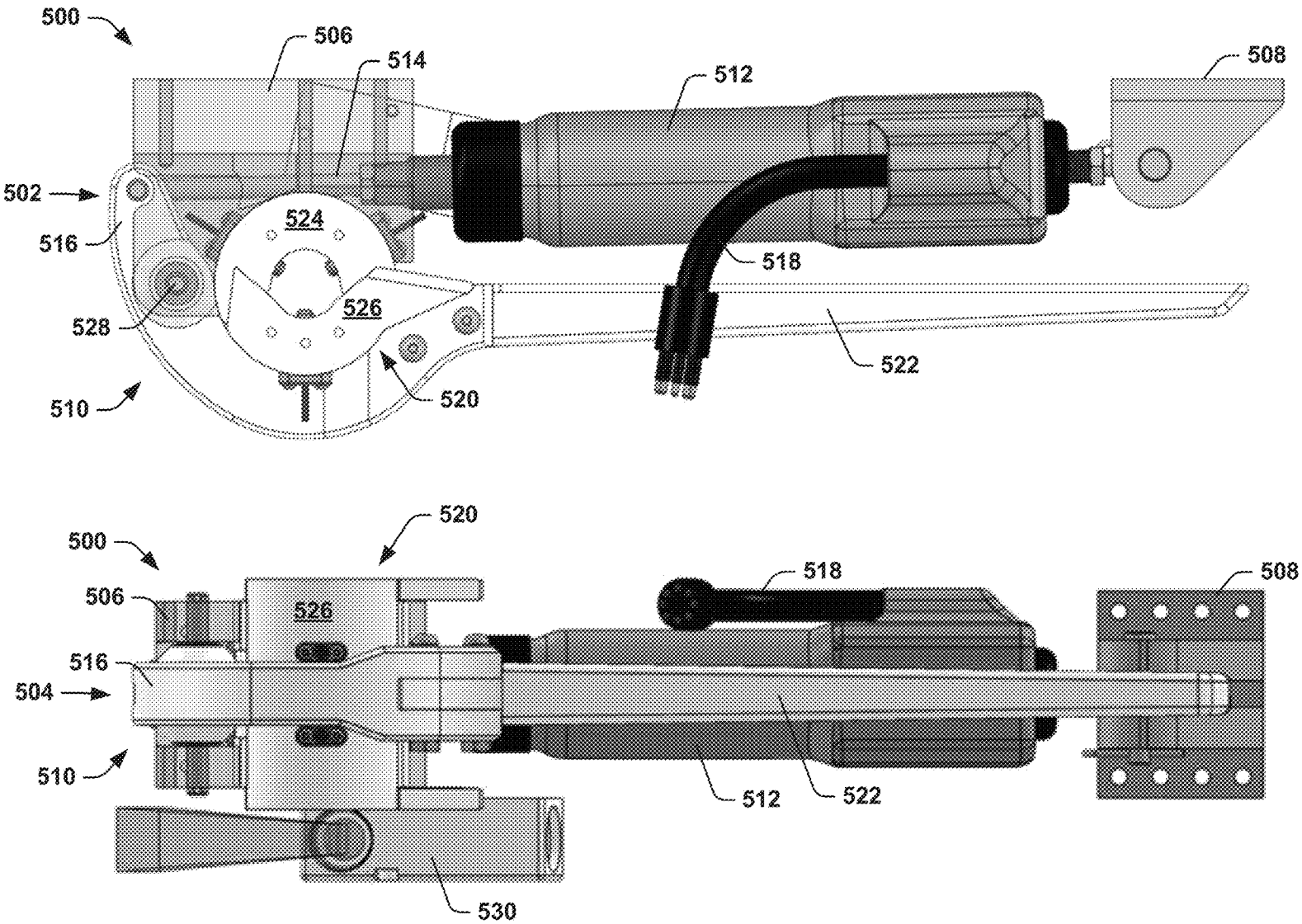
FIG. 5 illustrates an example of an underwater vehicle docking assembly.

FIG. 5 illustrates an example diagram of an underwater vehicle docking assembly 500. The docking assembly 500 can correspond to the docking assembly 108 and the docking assembly 404 in the respective examples of FIGS. 1 and 4. Therefore, reference is to be made to the examples of FIGS. 1 and 4 in the following description of the example of FIG. 5. The docking assembly 500 is demonstrated in two orthogonal views 502 and 504.

The docking assembly 500 is mounted to the lateral side of the underwater vehicle by a mounting block 506 and a bracket 508. The docking assembly 500 includes a hook assembly 510 and an actuator 512. The actuator 512 interconnects the hook assembly 510 and the bracket 508. The actuator 512 is configured to provide axial motion of a piston 514 to push and pull on a mechanical lever 516 in the hook assembly 510, as described in greater detail herein. For example, the actuator 512 can be a hydraulic actuator, a solenoid actuator, an electrical motor with a lead screw, or any of a variety of devices to provide axial motion. In the example of FIG. 5, the hook assembly 510 is demonstrated in a closed state. The actuator 512 also includes a power cable 518 that can be configured to receive power from the underwater vehicle (e.g., from a battery therein).

In the example of FIG. 5, the hook assembly 510 includes a jaw assembly 520 and a docking arm 522. The jaw assembly 520 is demonstrated as including a first portion 524 that is fixed to the mounting block 506 and a second portion 526 that is fixed to the docking arm 522. The first and second portions 524 and 526 of the jaw assembly 520 are configured to define a generally cylindrical, hollow tubular structure when brought together. In the example of FIG. 5, the first portion 524 forms approximately ⅔ of the cylinder and the second portion 526 forms approximately ⅓ of the cylinder. However, it will be appreciated that the jaws may each form approximately one-half of the cylinder, or each jaw may form other fractions of a cylinder, so long as when brought together, the two portions 524 and 526 define a space suitable to capture the docking rod therebetween. While, in the illustrated embodiment, the two portions 524 and 526 combine to completely encircle the docking rod, it will be appreciated that the two jaws need not completely encircle the docking rod so long as any circumferential gap between the jaws is smaller than the diameter of the docking rod.

The docking arm 522 and the second portion 526 are mechanically coupled to the lever 516. Therefore, in response to the actuator 512 pulling on the lever 516, the hook assembly 510 can be switched to the open state, such that the docking arm 522 and the second portion 526 of the jaw assembly 520 swing about a hinge 528 to which the lever 516 is mechanically coupled (e.g., integrally formed with). In the open state, the hook assembly 510 can thus capture the docking rod and guide the docking rod via the docking arm 522 into the open jaw assembly 520.

The docking assembly 500 also includes a proximity sensor 530 that is located beneath the jaw assembly 520. The proximity sensor 530 can be, for example, as an optical sensor attached to the mounting block 506 that is configured to detect when the docking rod is positioned within the jaw assembly 520. As an example, the proximity sensor 530 may actively send out an optical beam and detect a reflection from the docking rod when the docking rod is in place in the jaw assembly 520. Alternatively, if sufficient ambient light is available (e.g., if the AUV and docking rod are close to the surface of the water), the proximity sensor 530 may detect the docking rod obscuring the ambient light when the docking rod is in position to be captured by the jaw assembly 520. In another example, the proximity sensor 530 can be implemented as any of a variety of non-optical (e.g., capacitive, acoustic, etc.) sensors to detect the position of the docking rod as it approaches the jaw assembly 520.

In response to detecting that the docking rod has been positioned into the open jaw assembly 520 via the proximity sensor 530, the actuator 512 can be configured to push the lever 516 to switch the hook assembly 510 to the closed state. Therefore, the docking arm 522 and the second portion 526 of the jaw assembly 520 swing about the hinge 528 to which the lever 516 is mechanically coupled to enclose the docking rod between the first and second portions 524 and 526 of the jaw assembly 520. In the closed state, the docking rod is surrounded by the jaw assembly 520, such that the brush contacts can be provided in electrical connection with the electrical contacts of the docking rod.

While not demonstrated in the example of FIG. 5, the jaw assembly 520 can include rollers to facilitate axial motion of the docking rod through the closed jaw assembly 520 during the docking of the underwater vehicle to the underwater dock. The rollers can thus minimize damage resulting from scraping that can occur between the docking rod and the internal edges of the jaw assembly 520.

Figure 6:
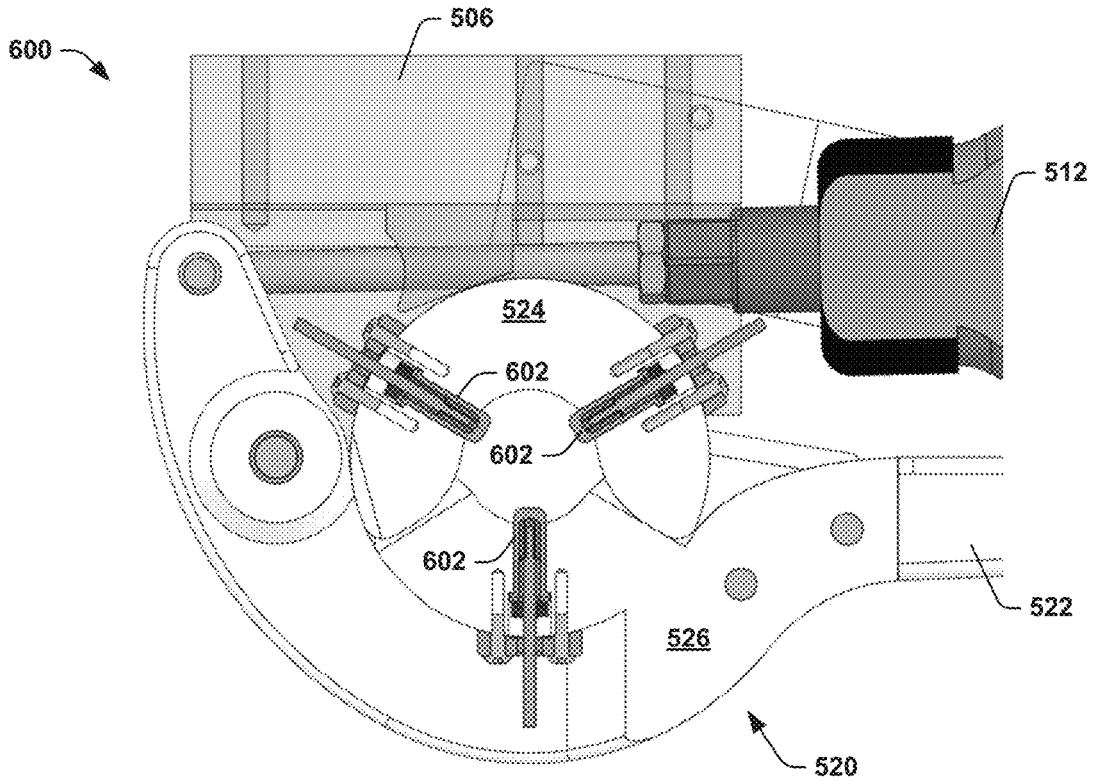
FIG. 6 illustrates another example of an underwater vehicle docking assembly.

FIG. 6 illustrates another example of an underwater vehicle docking assembly 600. The docking assembly 600 is demonstrated as a zoomed-in version of the docking assembly 500 in the example of FIG. 5, with the jaw assembly 520 demonstrated in a cutaway view. Therefore, like reference numbers are used in the example of FIG. 6 as provided in FIG. 5.

The docking assembly 600 demonstrates that the jaw assembly 520 includes a set of three brush contacts 602 that are arranged in an angularly equal polar array (e.g., separated by 120° with respect to each other). The brush contacts 602 are thus demonstrated as three equally spaced self-insulating brushes that extend radially through the jaw assembly 520 relative to the longitudinal axis of the docking rod. However, other configurations are likewise possible. Additionally, the jaw assembly 520 can include two sets of the brush contacts 602 that are arranged within the jaw assembly 520 to provide redundant electrical connection to the docking rod, thereby mitigating arcing of the electrical connection to the docking rod. As an example, the brush contacts 602 can be arranged as three sets (e.g., pairs) of brush contacts 602, with each set being electrically connected and being offset with respect to each other along the axis of the docking rod.

The size and number of the brush contacts 602 can cooperate with the size and separation of the self-insulating electrical contacts on the docking rod to ensure that at least one brush contact 602 remains in contact with an electrical contact of each polarity on the docking rod. Therefore, the configuration is designed to ensure that a single brush contact 602 does not bridge the two electrical contacts of the docking rod, as described in greater detail herein. Additionally, as described above, both the brush contacts 602 and the electrical contacts of the docking rod can be formed from a self-passivating material. In the example of FIG. 6, the brush contacts 602 are demonstrated as spring-loaded to provide sufficient contact pressure to scrape away the passivation of the self-passivating materials of the brush contacts 602 and the electrical contacts, thereby providing sufficient electrical connection.

Figure 7:
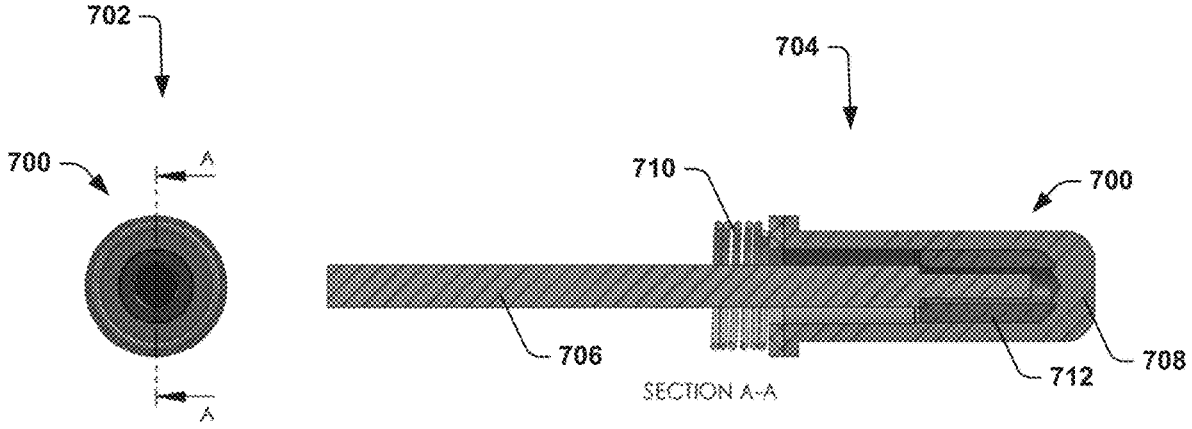
FIG. 7 illustrates an example of a brush contact.

FIG. 7 illustrates an example of a brush contact 700. The brush contact 700 can correspond to one of the brush contacts 602 in the example of FIG. 6. The brush contact 700 is demonstrated in the example of FIG. 7 in orthogonal views 702 and 704. The view 702 is demonstrated in a circular cross-section, and the second view 704 demonstrates a cutaway side view of the brush contact 700 that includes an electrical wire 706 electrically coupled to a brush surface 708 formed of the self-passivating material. The brush contact 700 also includes a spring 710 configured to provide spring force of the brush contact 700 to the electrical contact of the docking rod. As an example, a washer can enable rotational movement between the spring and the brush contact 700.

The brush contact 700 also includes a deformable, conductive crimp insert 712 that secures the electrical wire 706 and provides a stable electrical connection between the electrical wire 706 and the brush surface 708. As an example, additional materials (e.g., solder, conductive adhesive, etc.) may further solidify the electrical connection between the crimp insert 712, the brush surface 708, and the electrical wire 706. The electrical connection may be sealed with a watertight, insulating potting compound to protect the connection from the environment.

Figure 8:
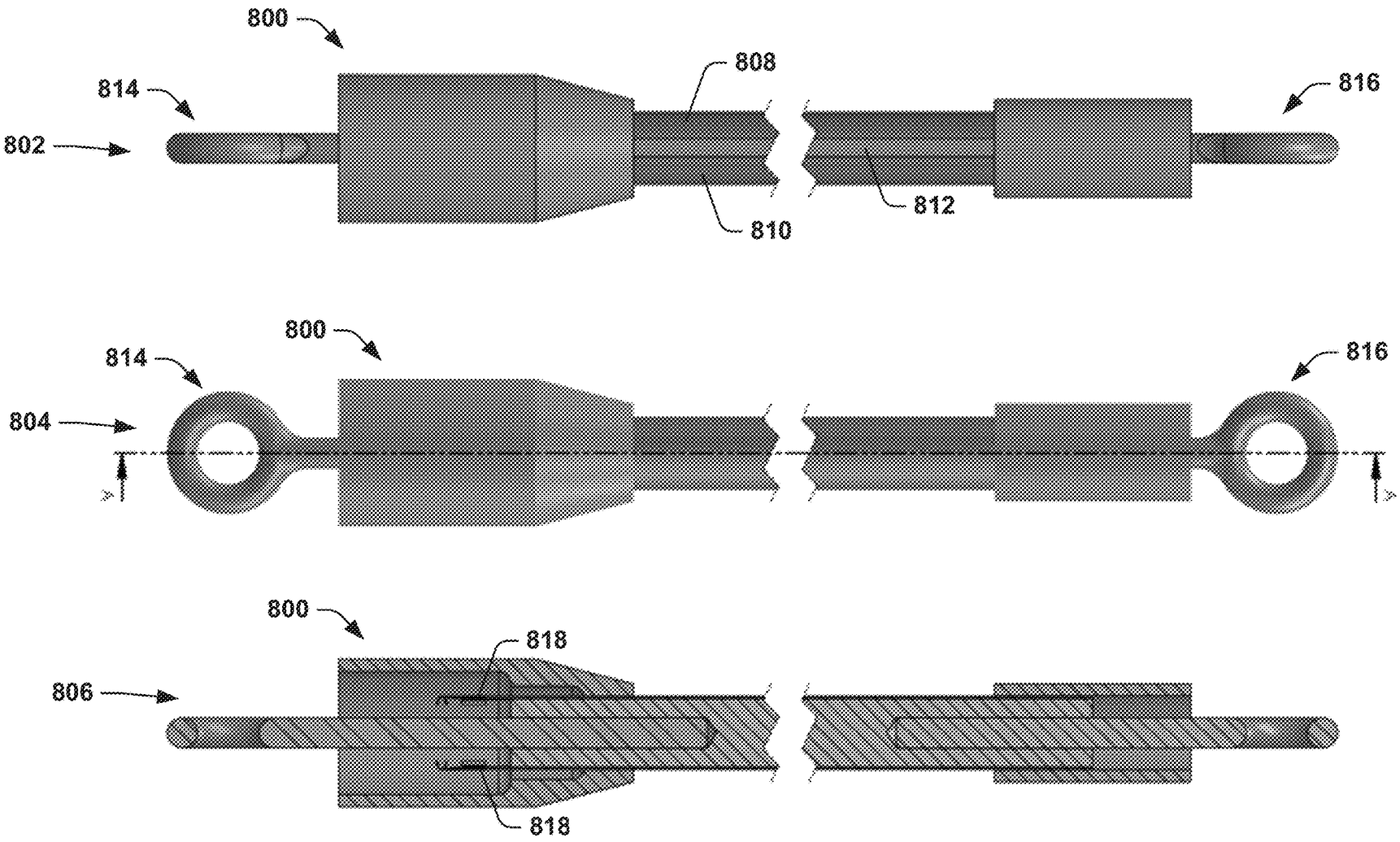
FIG. 8 illustrates an example diagram of a docking rod.

FIG. 8 illustrates an example diagram of a docking rod 800. The docking rod 800 is demonstrated in a first view 802, a second view 804, and a third view 806. The docking rod 800 can correspond to the docking rod 122 and the docking rod 212 in the respective examples of FIGS. 1 and 2. Therefore, reference is to be made to the examples of FIGS. 1 and 2 in the following description of the example of FIG. 8.

The first view 802 illustrates a side view of the docking rod 800 with self-insulating material to provide power to the underwater vehicle. The docking rod 800 includes two electrical contacts 808 and 810 formed from a self-insulating material that provides an insulating surface layer when exposed to water. The two electrical contacts 808 and 810 are separated by an insulating gap 812, which may be filled with non-conductive material. In one example, the two self-insulating electrical contacts 808 and 810 may be formed by cutting grooves along the length of a tube of self-insulating material. In another example, the docking rod 800 may include an insulating core (e.g., polyvinyl chloride (PVC), fiberglass, insulating tube over wire-rope strength member, etc.) supporting the self-insulating material of the electrical contacts 808 and 810.

The second view 804 illustrates a rotated side view of the docking rod 800 that shows anchor points 814 and 816 on opposite ends of the docking rod 800. The docking rod 800 and the self-insulating electrical contacts 808 and 810 may extend for a relatively small length of the overall docking system (e.g., approximately two meters). The anchor point 814 at a first end of the docking rod 800 structurally connects the docking rod 800 to the seafloor anchor through the docking controller (e.g., the docking controller 214). The anchor point 816 at a second end opposite the first end of the docking rod 800 structurally connects the docking rod 800 to the float 210. In the example of FIG. 8, the anchor points 814 and 816 are demonstrated as eye bolts. However, any suitable combination of anchoring elements can be used.

The third view 806 illustrates a cutaway view of the docking rod 800 demonstrating an example of the interior structure of the docking rod 800. The anchor points 814 and 816 are connected to the insulating core, such as to provide the structural support of the docking rod 800 in the underwater dock. In one example, the insulating core may include one or more strength members (e.g., stiffening rods) to provide additional structural support to the docking rod 800, thus rendering the docking rod semi-flexible. The self-insulating electrical contacts 808 and 810 are electrically connected through terminal contacts 818 to electrical wires (not demonstrated). In one example, the electrical wires can be attached to the self-insulating electrical contacts 808 and 810 through a physical connection (e.g., crimping, set screws, etc.). Additionally, the electrical connection between the electrical wires and the self-insulating electrical contacts 808 and 810 may be made by other processes (e.g., soldering, welding, brazing, conductive adhesive, etc.). To protect the connection between the electrical wires and the self-insulating electrical contacts 808 and 810 from the underwater environment, the ends of the docking rod 800 may be sealed with a watertight, insulating potting compound.

Figure 9:
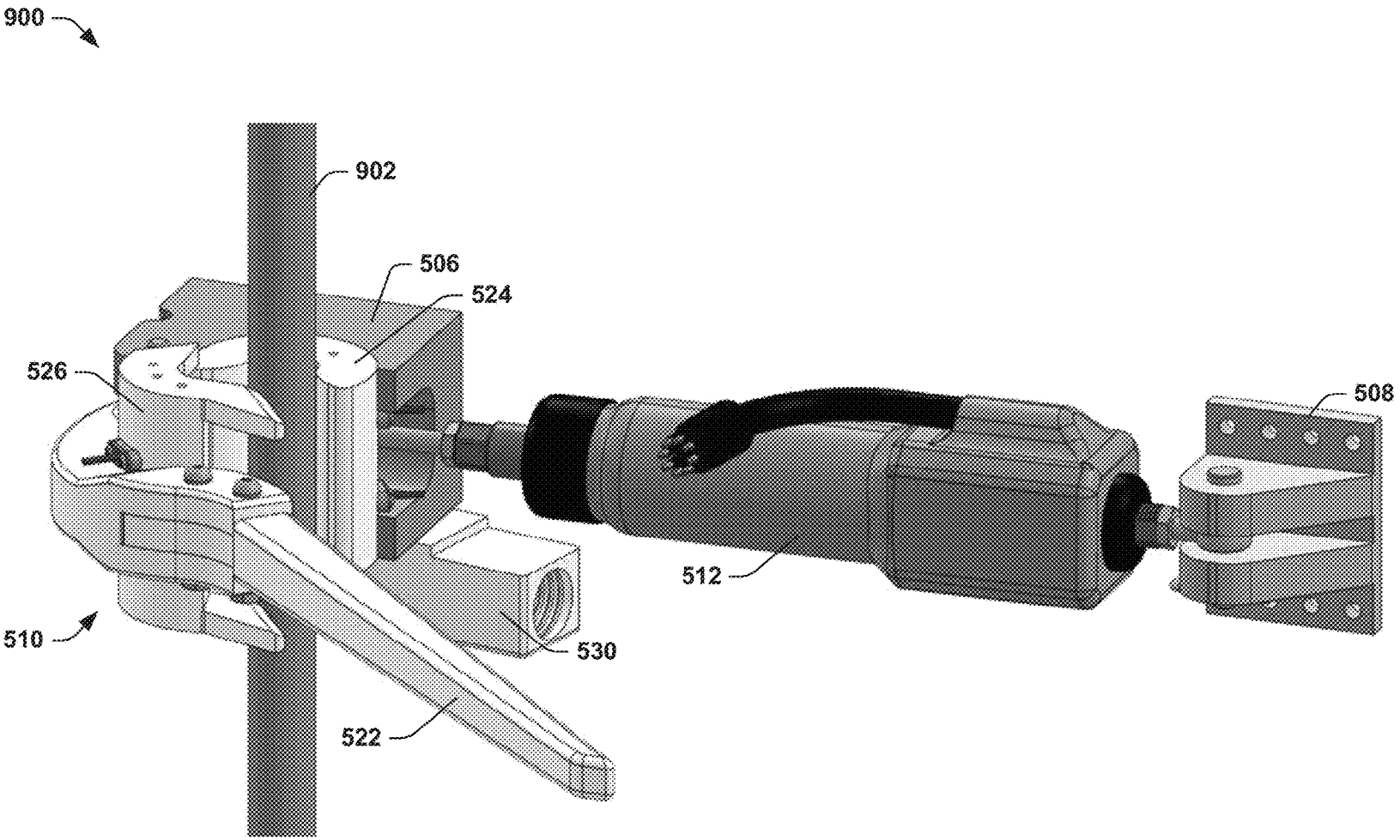
FIG. 9 illustrates an example diagram of underwater docking.
Figure 10:
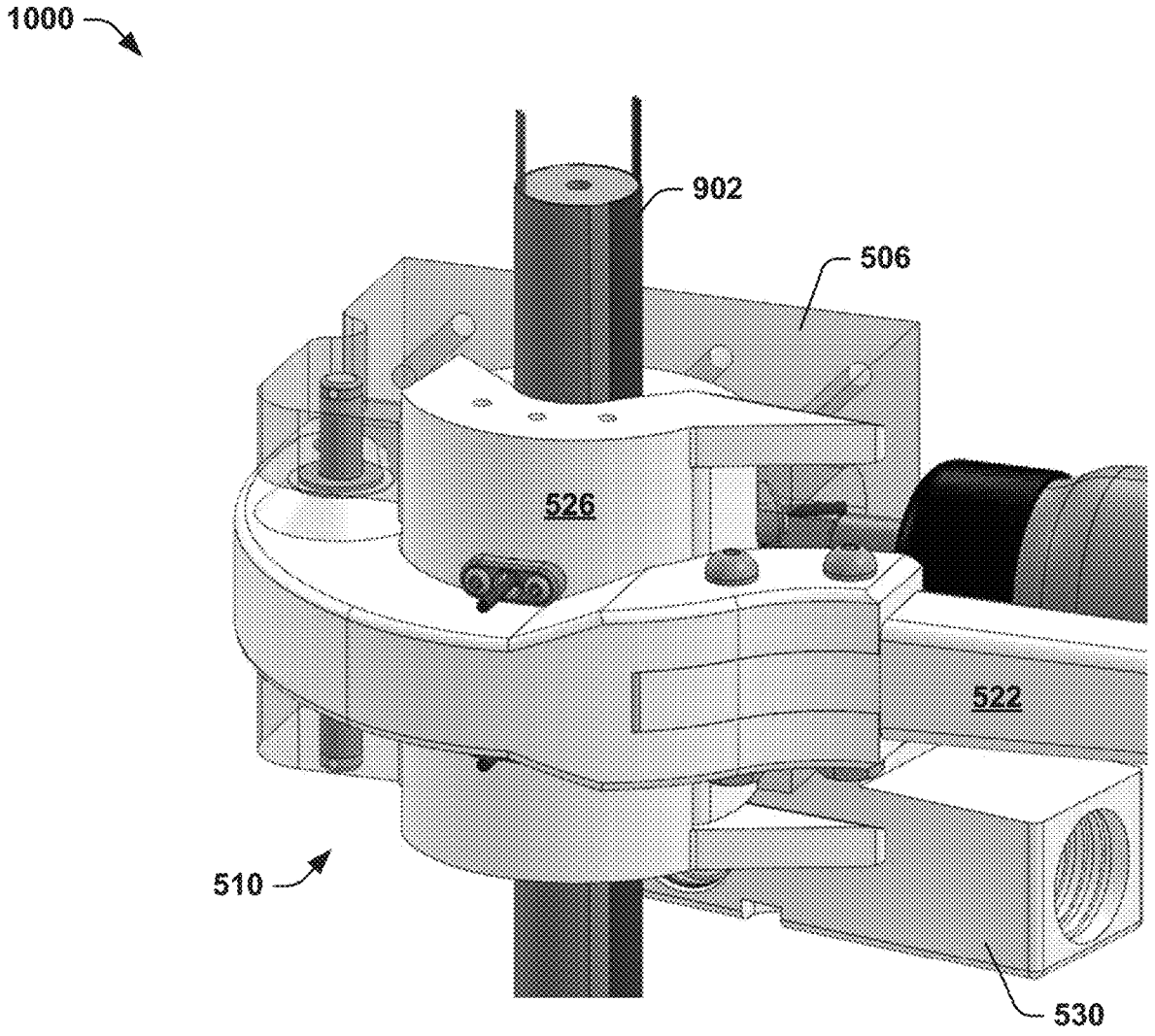
FIG. 10 illustrates another example diagram of underwater docking.

FIGS. 9 and 10 illustrate example diagrams 900 and 1000, respectively, of underwater docking. The diagrams 900 and 1000 demonstrate the docking assembly 500 docking with a docking rod 902. Because the docking assembly in the example of FIGS. 9 and 10 correspond to the docking assembly 500 in the example of FIG. 5, like reference numbers are used in the examples of FIGS. 9 and 10 as FIG. 5.

The hook assembly 510 is demonstrated in the example of FIG. 9 in the open state. In the open state, the hook assembly 510 can thus capture the docking rod 902 and guide the docking rod 902 via the docking arm 522 into the open jaw assembly 520. In response to detecting that the docking rod has been positioned into the open jaw assembly 520 via the proximity sensor 530, the actuator 512 can be configured to push the lever 516 to switch the hook assembly 510 to the closed state. Therefore, the docking arm 522 and the second portion 526 of the jaw assembly 520 swing about the hinge 528 to which the lever 516 is mechanically coupled to enclose the docking rod between the first and second portions 524 and 526 of the jaw assembly 520. The hook assembly 510 is demonstrated in the example of FIG. 10 in the closed state. In the closed state, the docking rod 902 is surrounded by the jaw assembly 520, such that the brush contacts can be provided in electrical connection with the electrical contacts of the docking rod 902.

In summary, the techniques presented herein enable an underwater vehicle to exchange data and recharge from an underwater dock using an electrical connector with self-insulating contacts. The positioning of the connection between the underwater vehicle and the underwater dock reduces the sudden deceleration of docking by allowing the underwater dock itself to move and by allowing the underwater vehicle to rotate around the underwater dock to dissipate kinetic energy and momentum. The self-insulating material used in the electrical connection between the underwater vehicle and the underwater dock enables a low resistance electrical connection while preventing leakage or arcing through the underwater environment.

Figure 11:
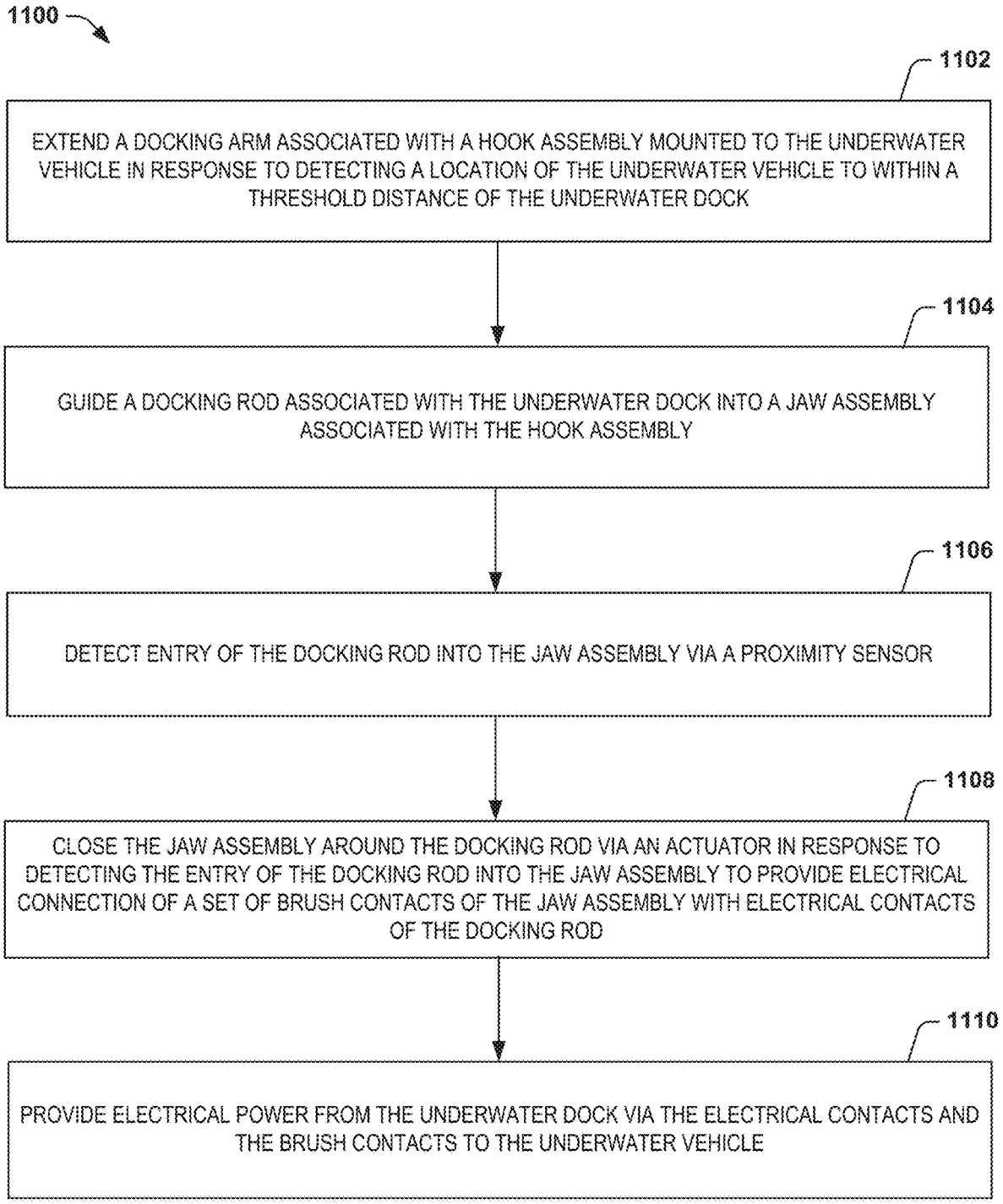
FIG. 11 illustrates an example of a method for docking an underwater vehicle to an underwater dock.

In view of the foregoing structural and functional features described above, a methodology in accordance with various aspects of the disclosure will be better appreciated with reference to FIG. 11. It is to be understood and appreciated that the method of FIG. 11 is not limited by the illustrated order, as some aspects could, in accordance with the present disclosure, occur in different orders and/or concurrently with other aspects from that shown and described herein. Moreover, not all illustrated features may be required to implement a methodology in accordance with an aspect of the present examples.

FIG. 11 illustrates an example of a method 1100 for docking an underwater vehicle (e.g., the underwater vehicle 102) to an underwater dock (e.g., the underwater dock 104). At 1102, a docking arm (e.g., the docking arm 116) of a hook assembly (e.g., the hook assembly 110) mounted to the underwater vehicle is extended in response to detecting a location of the underwater vehicle to within a threshold distance of the underwater dock. At 1104, a docking rod (e.g., the docking rod 122) associated with the underwater dock is guided into a jaw assembly (e.g., the jaw assembly 114) associated with the hook assembly. At 1106, entry of the docking rod into the jaw assembly is detected via a proximity sensor (e.g., the proximity sensor 530). At 1108, the jaw assembly is closed around the docking rod via an actuator (e.g., the actuator 112) in response to detecting the entry of the docking rod into the jaw assembly to provide electrical connection of a set of brush contacts (e.g., the brush contacts 602) of the jaw assembly with electrical contacts (e.g., the electrical contacts 124) of the docking rod. Each of the electrical contacts and the brush contacts can be formed from a self-passivating material. At 1110, electrical power is provided from the underwater dock via the electrical contacts and the brush contacts to the underwater vehicle.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An underwater docking system comprising:

an underwater dock comprising a docking rod and a power source, the docking rod comprising electrical contacts disposed about a periphery of the docking rod and electrically connected to the power source; and a docking assembly mounted on an underwater vehicle, the docking assembly comprising a hook assembly and an actuator, the hook assembly comprising a docking arm and a jaw assembly, the docking arm being configured to guide the docking rod into the jaw assembly, the actuator being configured to close the jaw assembly around the docking rod to provide electrical connection of a set of brush contacts of the jaw assembly with the electrical contacts of the docking rod to provide electrical power from the power source via the electrical contacts to the underwater vehicle, each of the electrical contacts and the brush contacts being formed from a self-passivating material.

2. The system of claim 1, wherein the underwater dock further comprises a beacon configured to provide a location signal to the underwater vehicle to facilitate docking of the underwater vehicle with the underwater dock.

3. The system of claim 1, wherein the docking rod comprises a pair of the electrical contacts that are disposed along respective opposite portions of the periphery of the docking rod, wherein the jaw assembly comprises three brush contacts that are equally angularly disposed to provide electrical connection of at least one of three brush contacts of the jaw assembly with each of the pair of electrical contacts of the docking rod when the jaw assembly is closed around the docking rod.

4. The system of claim 3, wherein the docking assembly further comprises a bridge circuit coupled to the three brush contacts, the bridge circuit being configured to rectify electrical power provided from the power source via the pair of electrical contacts to the three brush contacts.

5. The system of claim 1, wherein the underwater dock further comprises a docking controller configured to encode data onto the electrical power to provide a communication signal to the underwater vehicle via the electrical power.

6. The system of claim 1, wherein the actuator further comprises a proximity sensor configured to detect engagement of the docking rod with the jaw assembly, the actuator being configured to close the jaw assembly in response to detection of the engagement of the docking rod with the jaw assembly.

7. An underwater dock to provide for docking of an underwater vehicle, the system comprising:

an anchor configured to secure the underwater dock to a seabed;

a power source coupled to the anchor, the power source being configured to provide electrical power; and a docking rod electrically connected to the power source and comprising electrical contacts formed from a self-passivating material and disposed about a periphery of the docking rod, the electrical contacts being configured to provide the electrical power to the underwater vehicle that is configured to dock with the underwater dock via the docking rod.

8. The underwater dock of claim 7, further comprising a beacon configured to provide a location signal to the underwater vehicle to facilitate docking of the underwater vehicle with the underwater dock.

9. The underwater dock of claim 7, wherein the docking rod comprises a pair of the electrical contacts that are disposed along respective opposite portions of the periphery of the docking rod.

10. The underwater dock of claim 7, further comprising a docking controller configured to encode data onto the electrical power to provide a communication signal to the underwater vehicle via the electrical power.

11. An underwater vehicle docking assembly associated with an underwater vehicle, the assembly comprising:

a hook assembly comprising a docking arm and a jaw assembly, the docking arm being configured to guide a docking rod associated with an underwater dock into the jaw assembly, the jaw assembly comprising a set of brush contacts formed from a self-passivating material; and an actuator configured to close the jaw assembly around the docking rod in response to the docking rod being positioned in the jaw assembly to provide electrical connection of the brush contacts of the jaw assembly with electrical contacts of the docking rod to provide electrical power from the underwater dock via the electrical contacts to the underwater vehicle.

12. The assembly of claim 11, wherein the underwater vehicle comprises a sensor arrangement configured to receive a location signal provided from a beacon associated with the underwater dock to facilitate docking of the underwater vehicle with the underwater dock.

13. The assembly of claim 11, wherein the jaw assembly comprises three brush contacts that are equally angularly disposed to provide electrical connection of at least one of three brush contacts of the jaw assembly with each of a pair of electrical contacts disposed about a periphery of the docking rod when the jaw assembly is closed around the docking rod.

14. The assembly of claim 13, further comprising a bridge circuit coupled to the three brush contacts, the bridge circuit being configured to rectify electrical power provided from a power source associated with the underwater dock via the pair of electrical contacts to the three brush contacts.

15. The assembly of claim 11, wherein the actuator further comprises a proximity sensor configured to detect engagement of the docking rod with the jaw assembly, the actuator being configured to close the jaw assembly in response to detection of the engagement of the docking rod with the jaw assembly.

16. The assembly of claim 11, wherein the jaw assembly further comprises a set of rollers to facilitate axial motion of the docking rod through the jaw assembly.

17. The assembly of claim 11, wherein the assembly is arranged on a lateral side of the underwater vehicle a distance of less than approximately one-half a length of the underwater vehicle from a front of the underwater vehicle, wherein the underwater vehicle comprises a guide structure at the front of the underwater vehicle to guide the docking rod from the front of the underwater vehicle to the lateral side of the underwater vehicle.

18. A method for docking an underwater vehicle to an underwater dock, the method comprising:

extending a docking arm associated with a hook assembly mounted to the underwater vehicle in response to detecting a location of the underwater vehicle to within a threshold distance of the underwater dock;

guiding a docking rod associated with the underwater dock into a jaw assembly associated with the hook assembly;

detecting entry of the docking rod into the jaw assembly via a proximity sensor;

closing the jaw assembly around the docking rod via an actuator in response to detecting the entry of the docking rod into the jaw assembly to provide electrical connection of a set of brush contacts of the jaw assembly with electrical contacts of the docking rod, each of the electrical contacts and the brush contacts being formed from a self-passivating material; and providing electrical power from the underwater dock via the electrical contacts and the brush contacts to the underwater vehicle.

19. The method of claim 18, further comprising providing a location signal from the underwater dock to the underwater vehicle to facilitate the docking of the underwater vehicle with the underwater dock.

20. The method of claim 18, wherein the docking rod comprises a pair of the electrical contacts that are disposed along respective opposite portions of a periphery of the docking rod, wherein the jaw assembly comprises three brush contacts that are equally angularly disposed, wherein closing the jaw assembly comprises closing the jaw assembly around the docking rod to provide electrical connection of at least one of three brush contacts of the jaw assembly with each of the pair of electrical contacts of the docking rod when the jaw assembly is closed around the docking rod.

* * * * *